US006775954B1

(12) United States Patent
Sorkin

(10) Patent No.: US 6,775,954 B1
(45) Date of Patent: Aug. 17, 2004

(54) UPPER BEAM SLAB BOLSTER WITH PARALLEL PLATES

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 29 days.

(21) Appl. No.: 10/223,044

(22) Filed: Aug. 19, 2002

(51) Int. Cl.[7] ..... E04C 5/16
(52) U.S. Cl. ..... 52/686; 52/687
(58) Field of Search ..... 52/687, 677, 686, 52/688, 689, 681, 685; 403/135

(56) References Cited

U.S. PATENT DOCUMENTS 4,060,954 A * 12/1977 Liuzza ..... 52/677
4,513,551 A * 4/1985 Gauffin et al. ..... 52/364
4,689,867 A * 9/1987 Tolliver ..... 29/453
5,174,607 A * 12/1992 Hill ..... 281/45
5,664,390 A * 9/1997 Sorkin ..... 52/687
6,023,898 A * 2/2000 Josey ..... 52/309.5
6,412,233 B1 * 7/2002 Jones ..... 52/92.2
6,578,335 B2 * 6/2003 Poliquin ..... 52/481.2
6,663,316 B1 * 12/2003 Harris ..... 404/136
2001/0004820 A1 * 6/2001 Poliquin ..... 52/481.1

OTHER PUBLICATIONS

CONAS Brochure, "Semifix—Beam Bolsters" and "U–Fix—Slab Bolsters", circa 1993, p. 4.
Meadow Steel Products Brochure, "Beam Bolsters", 1994, p. 3.

* cited by examiner

*Primary Examiner*—Carl D. Friedman
*Assistant Examiner*—Kevin McDermott
(74) *Attorney, Agent, or Firm*—Harrison & Egbert

(57) ABSTRACT

A bolster for use in construction having a plurality of leg members arranged in generally parallel spaced relationship to each other, a beam integrally formed with the plurality of leg members and extending transversely across the leg members, a first plate affixed to one side of the plurality of leg members and a second plate affixed to an opposite side of the plurality of leg members. Each of the plates has a generally flat bottom surface. A clip is provided on the plates for fixedly attaching the plates to respective feet of the leg members.

13 Claims, 3 Drawing Sheets

UPPER BEAM SLAB BOLSTER WITH PARALLEL PLATES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to bolsters that are used in construction activities for the support of post-tension cables, rebars or mesh. More particularly, the present invention relates to upper beam bolsters that are designed for support on underlying layers of mesh and rebar or on slab-on-grade surfaces. Additionally, the present invention relates to plates that can be attached to the existing bolsters so as to convert such bolsters for upper beam use.

BACKGROUND OF THE INVENTION

Bolsters are commonly used in the construction industry for the support of post-tension cables, rebars, or mesh above a surface. Typically, when such materials are used, they must be supported above the surface when the concrete is poured. These bolsters are used with poured decks. In normal use, the bolster is positioned on the deck and includes a beam which extends across a plurality of leg members. This beam is formed so as to contact and support the rebar while the base of the bolster rests on the deck or on a grade. When the concrete is poured, the bolster will support the rebar a proper distance above the bottom surface.

In normal use, such bolsters are preformed so that they can be installed quickly and easily upon the deck. Conventionally, the preformed bolster will have a plurality of leg members and a steel rod welded to a top surface of each of the leg members. The rod will serve as a receiving area for the rebar. Conventionally, these bolsters are formed in preset lengths. If it is necessary to extend the bolster across a long surface of the deck, then the ends of the beams of adjacent bolsters will be wired together such that the bolsters are in an end-to-end relationship.

The most common bolster that is employed is a metal bolster manufactured by Meadow Steel Products of Tampa, Fla. This bolster has a plurality of inverted U-shaped leg members having outwardly extending foot portions. A rigid tubular rod having a slight waveform pattern formed thereon is welded to the middle of the inverted U-shaped leg members. Each of the leg members is generally arranged in parallel relationship to each other. The feet of each of the leg members will rest on the deck while the rebar is supported. After the concrete has solidified, and the deck is removed, the bottom surfaces of the feet will be exposed. As such, it is necessary to coat the feet with an anti-rust material. Alternatively, stainless steel material can be employed for the leg members and their associated feet.

Corrosion and cost are major problems affecting the bolster of Meadow Steel Products. In order to form such a bolster, a great deal of manufacturing must take place, including metal forming, bending, dipping, and welding.

These activities, along with the cost of the material used to form the bolster, make the cost of the bolster relatively expensive. If the bolster is not coated or made of a stainless steel material, then corrosion can adversely affect the product. This corrosion can even occur when the metal is coated.

In the past, various attempts have been made to create bolsters of plastic material that can serve the purposes of the bolster of Meadow Steel Products. In general, such efforts have resulted in plastic chairs that are ineffective, cumbersome to use, or unable to properly withstand the forces imparted by the rebar upon the bolster. One such plastic bolster, manufactured by Conac, includes a central beam which is integrally formed with a plurality of leg members. Each of the leg members extends downwardly so as to present a flat surface to the underlying deck. No feet are provided which allow the bolster to be stapled to the deck. Additionally, the configuration of this Conac bolster allows for easy deformation. It is very difficult and time consuming to join lengths of the Conac bolster together. The Conac bolster also lacks the suitable wave form pattern for the receipt of the rebar on the top surface of the bolster. This plastic bolster is often broken, collapsed, or tipped over in actual use. The base of such a bolster has only a very small area of contact with the deck. As such, these plastic bolsters lack the strength and ability to withstand the loads imparted to them.

U.S. Pat. No. 5,664,390, issued on Sep. 9, 1997 to the present inventor, describes a bolster for use in construction. This bolster has a plurality of leg members arranged in parallel relationship and a beam integrally formed with the plurality of leg members and extending across the plurality of leg members. Each of the plurality of leg members has a foot for contacting the underlying surface. Each of the leg members includes a central body portion, a first leg extending downwardly from one side of the central body portion and a second leg extending downwardly from an opposite side of the central body portion. The foot is formed at an end of each of the first and second legs opposite the central body portion. The foot includes a plurality of pin-like projections extending outwardly from a bottom surface thereof. This bolster is of a type for stapling and fixed attachment to an underlying deck. However, under certain circumstances, it would be desirable to be able to use these bolsters for "upper beam" purposes. Upper beam bolsters are often used upon the top of mesh or layers of strands. The upper beam bolsters are commonly used in highway construction where multiple layers of steel are laid out. Under other circumstances, a widened or flat base is required for slab-on-grade construction. The relatively small and narrow feet would sink into sand or dirt if the bolsters of U.S. Pat. No. 5,664,390 were used for "upper beam" purposes. In other circumstances, upper beam slab bolsters are used on corrugating steel decking so as to be in flat surface-to-surface contact with such steel flat surfaces. As such, a need has developed so as to allow the bolster of U.S. Pat. No. 5,664,390 to be properly adapted for upper beam bolster purposes.

It is an object of the present invention to provide an upper beam slab bolster that is corrosion-proof and relatively inexpensive.

It is another object of the present invention to provide an upper beam bolster which can be made from an easily assembleable bolster and support plate.

It is another object of the present invention to provide an upper beam bolster that can withstand the forces imparted to it.

It is still a further object of the present invention to provide an upper beam bolster that is easy to manufacture and easy to use.

These and other objects and advantages of the present invention will become apparent from a reading of the attached specification and appended claims.

BRIEF SUMMARY OF THE INVENTION

The present invention is a bolster for use in construction having a plurality of leg members arranged in generally parallel spaced relationship, a beam integrally formed with the plurality of leg members and extending transversely across the leg members, a first plate affixed to one side of the plurality of leg members and having a flat bottom surface, and a second plate affixed to a second side of the plurality of leg members and having a generally flat bottom surface.

In the present invention, each of the plurality of leg members includes a central body portion, a first leg extending downwardly from one side of the central body portion, and a second leg extending downwardly from an opposite side of the central body portion. The first leg is in planar alignment with the second leg. Each of the plurality of leg members includes a first foot formed at an end of the first leg and extending horizontally outwardly therefrom, and a second foot formed at an end of the second leg and extending horizontally outwardly therefrom. Each of the first and second feet have a top surface and a bottom surface.

In the preferred embodiment of the present invention, the first plate has a first clip means on a top surface thereof so as to fixedly receive the first foot of the plurality of leg members. The second plate has a second clip means on a top surface thereof for fixedly receiving the second foot of the plurality of leg members. Each of the first and second clip means has a first projection extending upwardly from the plate with a shoulder formed thereon and spaced from the plate and a second projection extending upwardly from the plate and having a shoulder formed thereon so as to face the shoulder of the first projection. The top surface of the foot is in abutment with the shoulders of the first and second projections. The first projection is in generally parallel relationship to the second projection. The first and second clip means are suitable for snap-fit receipt of the respective first foot and the second foot of the first and second plates.

In the present invention, the first plate has a rim extending upwardly peripherally along at least one side thereof. The first foot has an outer surface adjacent to this rim. The second plate also has a rim extending upwardly peripherally along at least one side thereof. The second foot has an outer surface adjacent to the rim of the second plate. Preferably, the rim of each of the first and second plates extends entirely around the respective plates.

In an alternative embodiment of the present invention, the first plate has a generally C-shaped cross-section. One side of the plurality of leg members is positioned within this first plate. The second plate also has a generally C-shaped cross-section. The opposite side of the plurality of leg members is positioned within this second plate. A plurality of guide elements are formed on the surface of the respective plates so that the feet of the leg members are received therein. The top surface of the respective plates overlies the respective top surface of the respective feet. Similarly, the bottom surface of the respective plates underlies the bottom surface of the respective feet.

In the present invention, the first plate and the second plate are arranged so as to extend in generally parallel relationship to each other. The flat bottom surfaces will be coplanar with each other. As such, the present invention allows the bolster to act as an upper beam slab bolster.

DETAILED DESCRIPTION OF THE INVENTION

Figure 1:
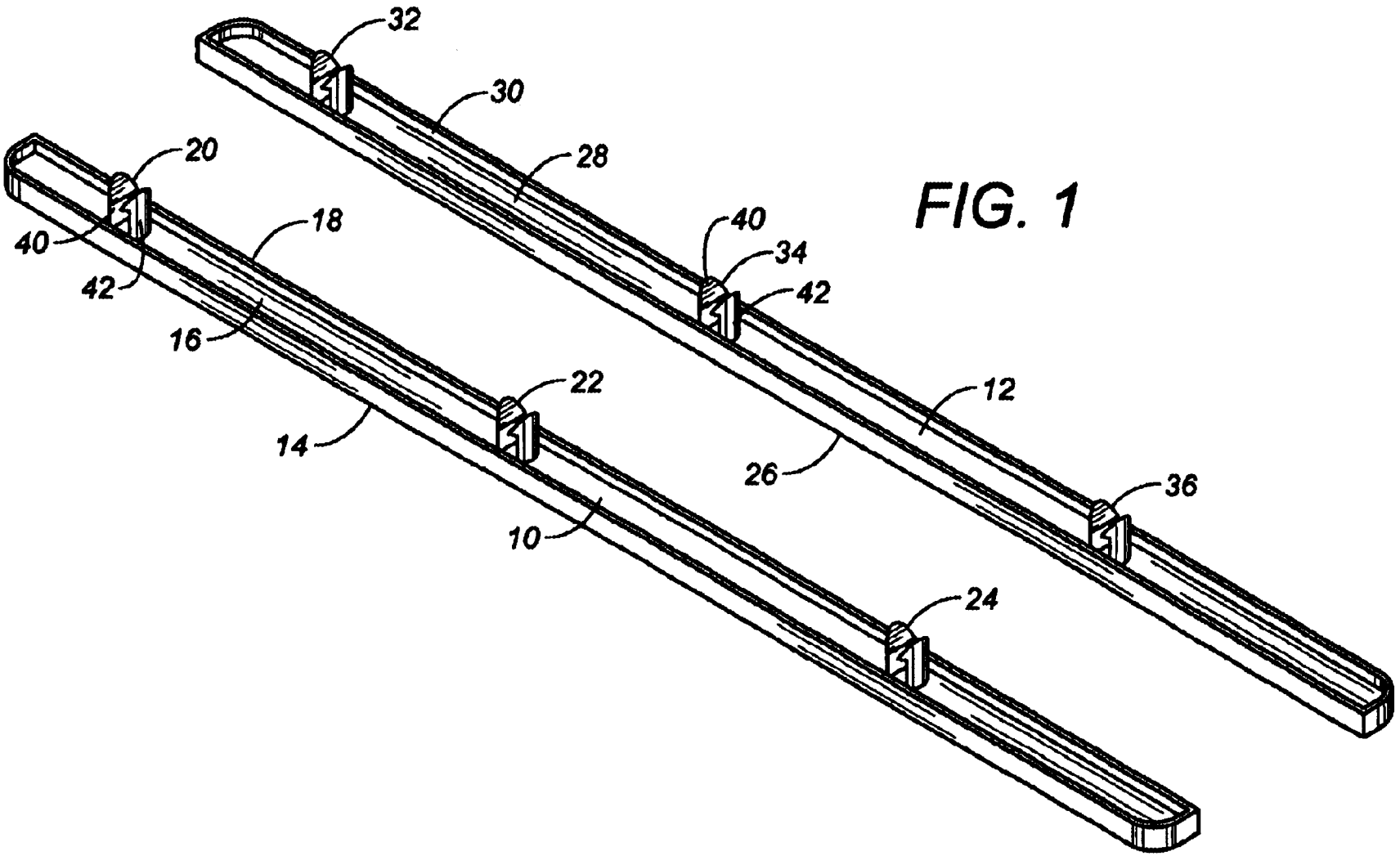
FIG. 1 is an upper perspective view of the first and second plates as used for the upper beam slab bolster of the present invention.

Referring to FIG. 1, there is shown the first plate 10 and the second plate 12 for use on the upper beam slab bolster in accordance with the teachings of the present invention. Each of the first plate 10 and the second plate 12 are mirror images of each other. The first plate 10 includes a flat bottom surface 14 and a generally flat top surface 16. A rim 18 extends around the periphery of the plate 10. Rim 18 will extend upwardly from the flat surface 16. A plurality of clips 20, 22 and 24 are formed so as to extend upwardly from the top surface 16. Similarly, the second plate 12 has a flat bottom surface 26, a flat top surface 28 and a rim 30 extending around the periphery of the flat surface 28. Clips 32, 34 and 36 are formed so as to extend upwardly from the flat surface 28.

As can be seen in FIG. 1, each of the clips 20, 22, 24, 32, 34 and 36 includes a first projection 40 and a second projection 42 extending upwardly from the surface of the respective plates so as to define a space therebetween. The projection 40 has a shoulder formed thereon. Similarly, the projection 42 has a shoulder formed thereon so as to face the shoulder formed on the projection 40. When a foot of a beam bolster is inserted between die projections 40 and 42, the respective shoulders will serve to retain the foot in its desired position against the top surface 16 of the respective plates 10 and 12. Similarly, the respective rims 18 and 30 of the plates 10 and 12 will serve to retain the foot member of the beam bolster in its desired position. Each of the plates 10 and 12 are integrally formed together of a polymeric material through an injection molding process.

Figure 2:
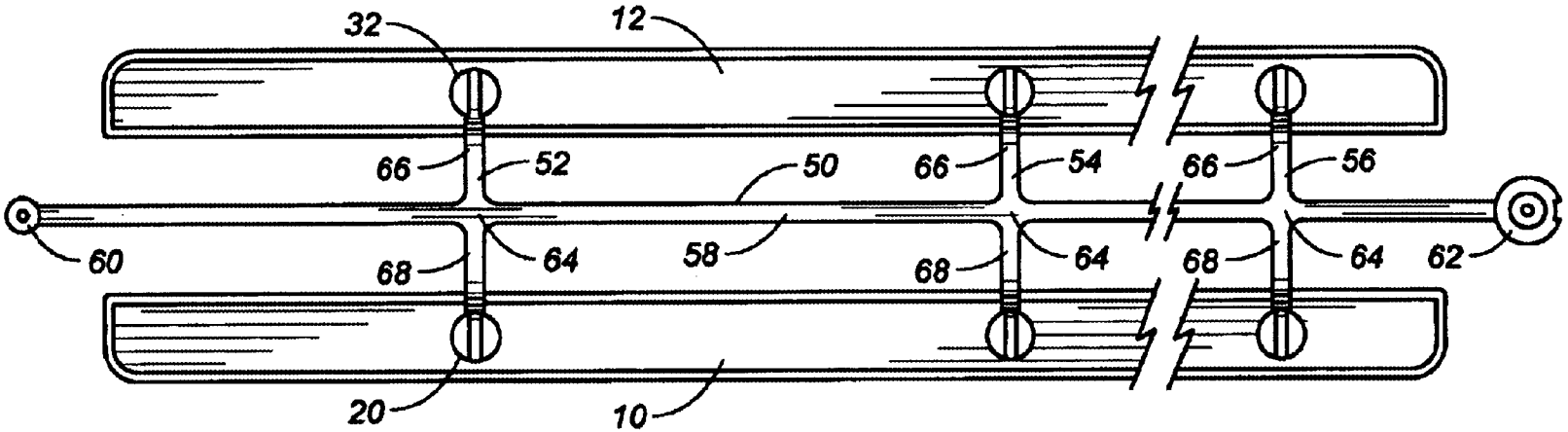
FIG. 2 is a plan view showing the upper beam slab bolster in accordance with the teachings of the preferred embodiment of the present invention.

FIG. 2 shows the application of the plates 10 and 12 onto a beam bolster 50. Beam bolster 50 has a plurality of leg members 52, 54 and 56 arranged in generally parallel spaced relationship. A beam 58 is integrally formed with the leg members 52, 54 and 56 and extends transversely across these leg members. The first plate 10 is affixed to one side of the plurality of leg members 52, 54 and 56. Similarly, the second plate 12 is affixed to an opposite side of the plurality of leg members 52, 54 and 56.

The beam bolster 50 is of a configuration to that shown in U.S. Pat. No. 5,664,390. Special connectors 60 and 62 are formed at opposite ends of the beam 58 for connection to an adjacent bolster. Various forms of connectors 60 and 62 can be contemplated within the scope of the present invention for the purpose of connecting the beam bolster 50 in end-to-end relationship, if necessary. As can be seen, the connectors 60 extend outwardly of the periphery of the first plate 10 and the second plate 12.

Each of the plurality of leg members 52, 54 and 56 includes a central body portion 64, a first leg 66 extending outwardly and downwardly of the central body portion 64 and a second leg 68 extending outwardly and downwardly from an opposite side of the central body portion 64. The first leg 66 will be in planar alignment with the second leg 68.

Figure 3:
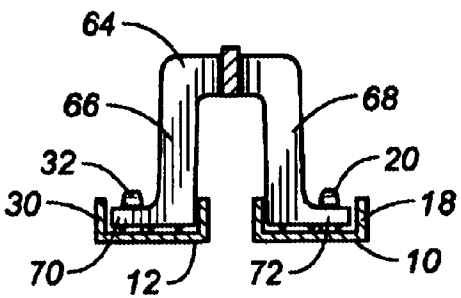
FIG. 3 is a cross-sectional view of the upper beam slab bolster in accordance with the teachings of the present invention.

As can be seen in FIG. 3, the first leg member 66 has a foot member 70 extending horizontally outwardly therefrom. Similarly, the leg member 68 has a foot 72 extending horizontally outwardly therefrom. The first foot 70 is in snap-fit relationship with the clip 32. Similarly, the foot 72 is affixed within the clip 20. The bottom surfaces of the feet 70 and 72 juxtaposed against the top surfaces 16 and 28 of the respective plates 10 and 12.

In FIG. 3, it can be seen that the rim 18 of the first foot 10 extends around the foot 72 of leg member 68. Similarly, the rim 30 of the second plate 12 will extend around the periphery of the foot 70 so as to retain the respective plates 10 and 12 around the feet of the beam bolster 10.

With reference to FIG. 2, it can be seen that the respective foot will be inserted between the projections 40 and 42 so as to reside with the top surface thereof juxtaposed against the shoulder of the respective projections. The plates 10 and 12 will extend along at least a portion of the length of the beam bolster in parallel spaced relationship. The relatively wide area of the bottom surfaces 14 and 26 of the plates 10 and 12 will allow the beam bolster 50 to function as an upper slab beam bolster. As such, the plates 10 and 12 are particularly adaptable for use with the beam bolster of U.S. Pat. No. 5,664,390 for converting such beam bolster into an upper slab beam bolster without the need to create new dies for injection molding machines. Workers having familiarity with the means for connecting the beam bolster 50 in end-to-end relationship will be easily able to snap-fit the respective plates 10 and 12 onto the feet of the beam bolster so as to carry out this conversion process. In the construction environment, it will not be necessary to have separate types of bolsters for upper beam use. It will be only necessary to supply the plates 10 and 12 for attachment to the existing bolsters. The mechanism for attachment of the feet of the beam bolster to the plates assures that the plates will be retained in a desired slab orientation.

Figure 4:
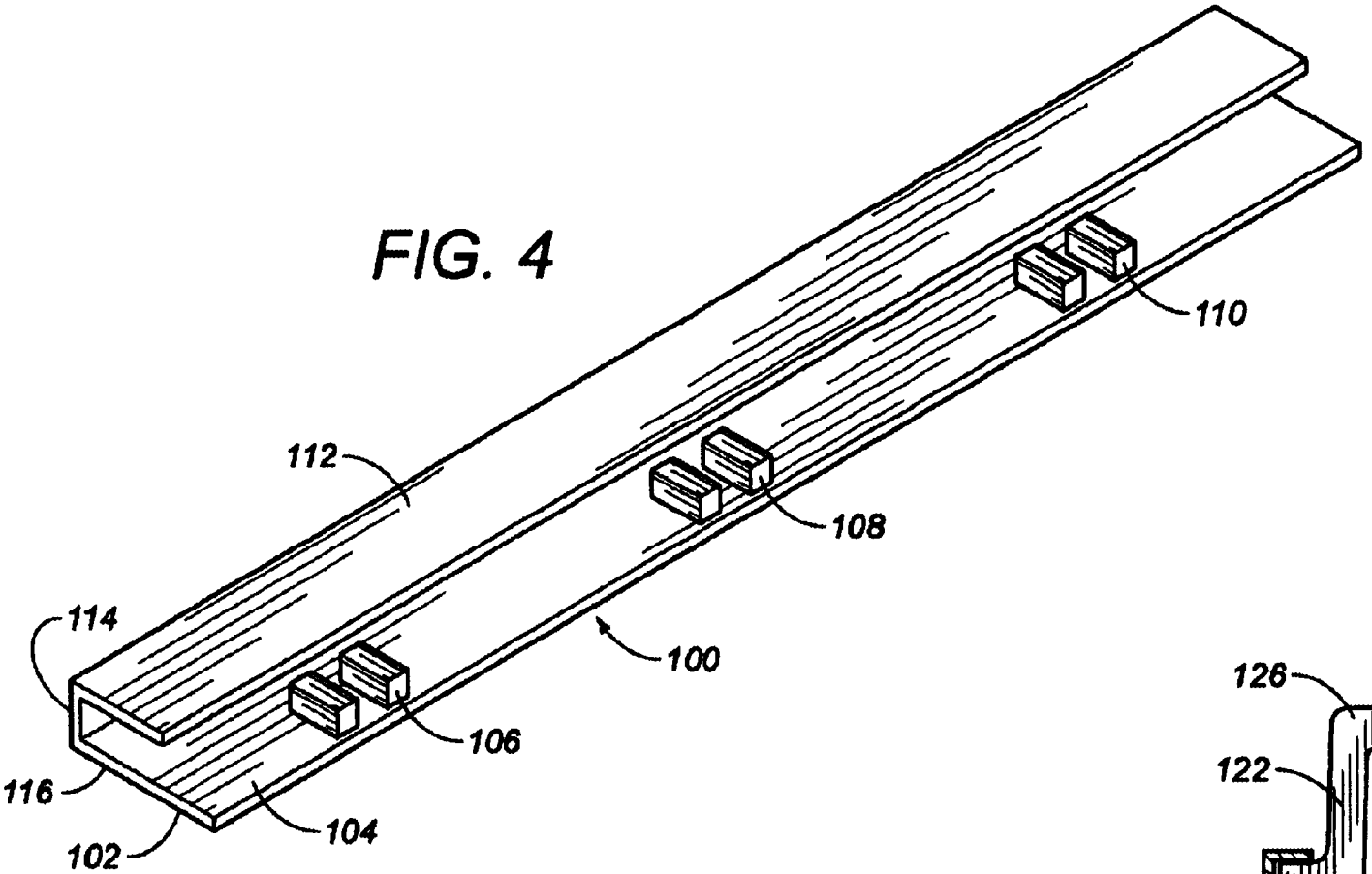
FIG. 4 is an upper perspective view of a single plate as used in the alternative embodiment of the present invention.

FIG. 4 shows an alternative embodiment 100 of the plate for use with the beam bolster of the present invention. Plate 100 has a generally C-shaped cross-section. In particular, the plate 100 has a bottom surface 102 of a generally flat configuration. A surface 104 is formed so as to allow for the placement of the bottom of the feet of the beam bolster thereon. Guide elements 106, 108 and 110 are formed on the surface 104 so as to allow for the fixed introduction of the feet therein. An upper surface 112 overlies the surface 104 in spaced relationship therewith. A side 114 extends between the surface 112 and the surface 104 so as to maintain the surfaces 112 and 104 in properly parallel spaced relationship. Ideally, the space 116 between the surface 112 and 104 will be sufficiently small so as to allow a relatively strong compressive fit between the surface 112 and the top surface of the foot and the bottom surface of the foot against surface 104. Plate 100 can be integrally formed of a polymeric material.

Figure 5:
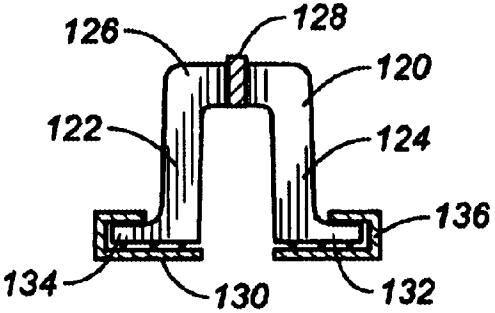
FIG. 5 is a cross-sectional view of the alternative embodiment of the upper beam slab bolster of the present invention.

FIG. 5 shows how the beam bolster 120 has its leg members 122 and 124 extending downwardly from central body portion 126. Beam 128 will extend centrally therealong in the manner described hereinbefore in the FIGS. 2 and 3. It can be seen that foot 130 extends horizontally outwardly from leg member 122. Foot 132 extends horizontally outwardly from leg member 124. A first plate 134 is affixed over the foot 130. Similarly, a plate 136 is placed over the foot 132. Since each of the plates 134 and 136 have a flat bottom surface. The attachment of the plates 134 and 136 to the respective feet 130 and 132 will properly create an upper beam slab bolster. Each of the plates 34 and 136 will be arranged in generally parallel planar relationship to each other.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A bolster for use in construction comprising:

a plurality of leg members arranged in generally parallel spaced relationship;

a beam integrally formed with said plurality of leg members, said beam extending transversely across said plurality of leg members, one set of legs of said plurality of leg members extending outwardly from one side of said beam, another set of legs of said plurality of leg members extending outwardly from an opposite side of said beam, each of said plurality of leg members comprising:

a central body portion;

a first leg extending downwardly from one side of said central body portion;

a second leg extending downwardly from an opposite side of said central body portion;

a first foot formed at an end of said first leg and extending horizontally outwardly therefrom, said first foot having a top surface and a bottom surface; and a second foot formed at an end of said second leg and extending horizontally outwardly therefrom, said second foot having a top surface and a bottom surface;

a first plate affixed to said one set of legs of said plurality of leg members, said first plate having a generally flat bottom surface; and a second plate affixed to said another set of legs of said plurality of leg members, said second plate having a generally flat bottom surface, said first plate extending in generally spaced parallel relationship to said second plate, said first plate having a first clip means on a top surface thereof, said first clip means for fixedly receiving said first foot of said plurality of leg members, said second plate having a second clip means on a top surface thereof, said second clip means for fixedly receiving said second foot of said plurality of leg members.

2. The bolster of claim 1, wherein the first leg is in planar alignment with said second leg.

3. The bolster of claim 1, each of said first and second clip means comprising:

a first projection extending upwardly from said plate and having a shoulder formed thereon and spaced from said plate; and a second projection extending upwardly from said plate and having a shoulder formed thereon so as to face said shoulder of said first projection, the top surface of the foot being in abutment with the shoulders of said first and second projections.

4. The bolster of claim 3, said first projection extending in generally parallel relationship to said second projection.

5. The bolster of claim 1, wherein, each of said first and second clip means is for snap-fit receipt of the foot therein.

6. A bolster for use in construction comprising:

a plurality of leg members arranged in generally parallel spaced relationship;

a beam integrally formed with said plurality of leg members, said beam extending transversely across said plurality of leg members, one set of legs of said plurality of leg members extending outwardly from one side of said beam, another set of legs of said plurality of leg members extending outwardly from an opposite side of said beam, each of said plurality of leg members comprising:

a central body portion;

a first leg extending downwardly from one side of said central body portion;

a second leg extending downwardly from an opposite side of said central body portion;

a first foot formed at an end of said first leg and extending horizontally outwardly therefrom, said first foot having a top surface and a bottom surface; and a second foot formed at an end of said second leg and extending horizontally outwardly therefrom, said second foot having a top surface and a bottom surface;

a first plate affixed to said one set of legs of said plurality of leg members, said first plate having a generally flat bottom surface; and a second plate affixed to said another set of legs of said plurality of leg members, said second plate having a generally flat bottom surface, said first plate extending in generally spaced parallel relationship to said second plate, said first plate having a rim extending upwardly peripherally along at least one side thereon, said first foot having an outer surface adjacent said rim, said second plate having a rim extending upwardly peripherally along at least one side thereof, said second foot having an outer surface adjacent said rim of said second plate.

7. The bolster of claim 6, said rim of said first plate extending entirely around a periphery of said first plate, said rim of said second plate extending entirely around a periphery of said second plate.

8. A bolster for use in construction comprising:

a plurality of leg members arranged in generally parallel spaced relationship;

a beam integrally formed with said plurality of leg members, said beam extending transversely across said plurality of leg members, one set of legs of said plurality of leg members extending outwardly from one side of said beam, another set of legs of said plurality of leg members extending outwardly from an opposite side of said beam;

a first plate affixed to said one set of said plurality of leg members, said first plate having a generally flat bottom surface; and a second plate affixed to said another set of said plurality of leg members, said second plate having a generally flat bottom surface, said first plate extending in generally spaced parallel relationship to said second plate, said first plate having a generally C-shaped cross-section, said one side of said plurality of leg members positioned interior of said first plate, said second plate having a generally C-shaped cross-section, an opposite side of said plurality of leg members positioned interior of said second plate.

9. The bolster of claim 8, said first plate having a plurality of guide elements formed on a surface thereof, said one of said plurality of leg members extending into said guide elements, said second plate having a plurality of guide elements formed on a surface thereof, said opposite side of said plurality of leg members extending into said guide elements of said second plate.

10. A bolster for use in construction comprising:

a plurality of leg members arranged in generally parallel spaced relationship;

a beam integrally formed with said plurality of leg members, said beam extending transversely across said plurality of leg members, one set of legs of said plurality of leg members extending outwardly from one side of said beam, another set of legs of said plurality of leg members extending outwardly from an opposite side of said beam, each of said plurality of leg members comprising:

a central body portion;

a first leg extending downwardly from one side of said body portion;

a second leg extending downwardly from an opposite side of said central body portion;

a first foot formed at an end of said first leg and extending horizontally outwardly therefrom, said first foot having a top surface and a bottom surface; and a second foot formed at an end of said second leg and extending horizontally outwardly therefrom, said second foot having a top surface and a bottom surface;

a first plate affixed to said one set of legs of said plurality of leg members, said first plate having a generally flat bottom surface; and a second plate affixed to said another set of legs of said plurality of leg members, said second plate having a generally flat bottom surface, said first plate having a generally C-shaped cross-section, said first plate having a top side overlying said top surface of said first foot, said first plate having a bottom surface underlying said bottom surface of said first foot, said second plate having a top side overlying said top surface of said second foot, said second plate having a bottom surface underlying said bottom surface of said second foot.

11. An article for attachment to at least one foot of a beam bolster comprising:

a plate having a generally flat bottom surface; and a clip means affixed to a top surface of said plate, said clip means for fixedly receiving the foot of a beam bolster therein, said plate having a rim extending upwardly peripherally therearound.

12. The article of claim 11, said clip means comprising:

a first projection extending upwardly from said plate and having a shoulder formed thereon and spaced from said plate; and a second projection extending upwardly from said plate and having a shoulder formed thereon so as to face said shoulder of said first projection.

13. The article of claim 12, said first projection extending in generally parallel relationship to said second projection.

* * * * *